US010677042B2

(12) United States Patent
Van Delden et al.

(10) Patent No.: US 10,677,042 B2
(45) Date of Patent: Jun. 9, 2020

(54) ASSEMBLY OF AN INSTRUMENT PANEL AND AN ANTI-FOULING SYSTEM

(71) Applicant: KONINKLIJKE PHILIPS N.V., Eindhoven (NL)

(72) Inventors: Martinus Hermanus Wilhelmus Maria Van Delden, Venlo (NL); Elvira Johanna Maria Paulussen, Reppel-Bocholt (BE); Roelant Boudewijn Hietbrink, Utrecht (NL)

(73) Assignee: Koninklijke Philips N.V., Eindhoven (NL)

( * ) Notice: Subject to any disclaimer, the term of this patent is extended or adjusted under 35 U.S.C. 154(b) by 0 days.

(21) Appl. No.: 16/076,720

(22) PCT Filed: Feb. 9, 2017

(86) PCT No.: PCT/EP2017/052795
§ 371 (c)(1),
(2) Date: Aug. 9, 2018

(87) PCT Pub. No.: WO2017/140561
PCT Pub. Date: Aug. 24, 2017

(65) Prior Publication Data

US 2019/0048710 A1 Feb. 14, 2019

(30) Foreign Application Priority Data

Feb. 15, 2016 (EP) ..... 16155682

(51) Int. Cl.
*E21B 47/017* (2012.01)
*E21B 47/01* (2012.01)
(Continued)

(52) U.S. Cl.
CPC ..... *E21B 47/011* (2013.01); *E21B 43/0107* (2013.01); *E21B 41/0007* (2013.01)

(58) Field of Classification Search
CPC ..... B63B 59/04; B63B 59/08; B08B 17/02
See application file for complete search history.

(56) References Cited

U.S. PATENT DOCUMENTS 4,814,035 A * 3/1989 Turner ..... B44C 1/17 156/230
5,182,007 A 1/1993 Takagi et al.
2013/0048877 A1* 2/2013 Thoren ..... G02B 6/102 250/492.1

FOREIGN PATENT DOCUMENTS

WO 2014188347 A1 11/2014
WO 2016000980 A1 1/2016

OTHER PUBLICATIONS

FMC Technologies, Subsea Engineering, Subsea Wellhead, FMC Technology, FMC Company, FMC Houston, Published on Apr. 9, 2013, Subsea Companies, https://www.youtube.com/watch?v=yTucNCAaqBA.

* cited by examiner

*Primary Examiner* — Sean D Andrish

(57) ABSTRACT

In an assembly of an instrument panel and an anti-fouling system, the instrument panel is designed for arrangement on a subsea structure that includes at least one instrument which is to be inspected and/or manipulated underwater, by a remotely operated underwater vehicle. The anti-fouling system includes at least one anti-fouling appliance for performing an anti-fouling action on at least a portion of the exterior surface of the instrument panel. The anti-fouling appliance may have at least one of various possible arrangements with respect to the instrument panel, including an exterior arrangement and an interior arrangement, and an arrangement on the exterior surface of the instrument panel. The anti-fouling appliance includes an ultraviolet light source. A (Continued)

light guide may be provided to guide light from the light source to desired destinations.

20 Claims, 3 Drawing Sheets

(51) Int. Cl.
*E21B 43/01* (2006.01)
*E21B 41/00* (2006.01)

ASSEMBLY OF AN INSTRUMENT PANEL AND AN ANTI-FOULING SYSTEM

CROSS-REFERENCE TO PRIOR APPLICATIONS

This application is the U.S. National Phase application under 35 U.S.C. § 371 of International Application No. PCT/EP2017/052795 filed on 9 Feb. 2017, which claims the benefit of European Patent Application No. 16155682.4, filed on 15 Feb. 2016. These applications are hereby incorporated by reference herein.

FIELD OF THE INVENTION

The invention relates to an assembly of an instrument panel and an anti-fouling system, the instrument panel being designed for arrangement on a subsea structure, particularly a subsea tree comprising at least one instrument which is to be inspected and/or manipulated underwater, particularly by means of a remotely operated underwater vehicle.

In the second place, the invention relates to an anti-fouling system intended for use in such assembly, which will hereinafter be referred to as anti-fouling panel assembly, and also to an instrument panel intended for use in the anti-fouling panel assembly.

In the third place, the invention relates to a marine system, comprising a subsea structure, particularly a subsea tree comprising at least one instrument which is to be inspected and/or manipulated underwater, particularly by means of a remotely operated underwater vehicle, and furthermore comprising at least one anti-fouling panel assembly, wherein the instrument panel of the assembly is arranged for allowing access to at least an element of the at least one instrument.

BACKGROUND OF THE INVENTION

In the field of offshore industry, the use of subsea trees is widespread, such trees also commonly being referred to as subsea Christmas trees. The fact is that such trees are of a complex structure, including valves, spools, fittings and the like. In general, subsea trees are intended for use at a subsea well, for example, a subsea oil well, and are adapted to be placed on top of a so-called wellhead which is designed to serve as an interface between a subsea tree and a subsea well. Subsea trees are mainly applied for controlling a flow of matter coming from the subsea well, particularly by realizing appropriate settings of valves, which does not alter the fact that other applications of subsea trees are possible as well. In any case, subsea trees may be adapted to perform one or more additional functions besides the intended main function, including injecting matter in the subsea well, realizing pressure relief, monitoring various parameters, and offering connection points for one or more devices to be used at the subsea well.

A subsea tree applied in an offshore operation is located at the sea bed, and in view thereof, a so-called remotely operated underwater vehicle is applied for operating and controlling the valves, reading indicators, etc. According to an important safety requirement, the various valves are properly tagged, wherein it is intended for the tags to be readable at all times during installation, operation and downtime of the subsea tree. In order to facilitate access of a remotely operated underwater vehicle to the various valves and other components of the subsea tree, a subsea tree is normally equipped with a so-called remotely operated vehicle (ROV) panel, which will be referred to as instrument panel in the context of this description. Thus, in a general sense, an instrument panel is designed to serve as an interface between a subsea tree and a remotely operated underwater vehicle. In particular, the instrument panel is adapted to provide access to at least an element of at least one instrument of a subsea tree, such as a control element in the form of a handle or the like, and is normally constituted by a coated steel plate which is provided with holes at appropriate positions.

When an instrument panel for arrangement on a subsea tree is at a position as intended, i.e. at a subsea position, it may happen that over time, readability of the tags is impaired, and it may even be so that access to the valves gets hindered. The reason is found in a phenomenon known as biological fouling or biofouling. Obviously, dangerous and unsafe situations may occur when the instrument panel suffers from bio fouling to such an extent that it is no longer possible to properly inspect the tags and/or control the instruments. Mechanical cleaning of instrument panels is difficult to realize due to their operating depth, which may be well beyond the reach of normal diving activities, i.e. lower than about 100 meters under the water surface. Hence, there is a need for a durable solution aimed at keeping a submerged instrument panel clean.

In general, biofouling is the accumulation of microorganisms, plants, algae, small animals and the like on surfaces. According to some estimates, over 1,800 species comprising over 4,000 organisms are responsible for biofouling. Hence, biofouling is caused by a wide variety of organisms, and involves much more than an attachment of barnacles and seaweeds to surfaces. Biofouling is divided into micro fouling which includes biofilm formation and bacterial adhesion, and macro fouling which includes the attachment of larger organisms. Due to the distinct chemistry and biology that determine what prevents them from settling, organisms are also classified as being hard or soft. Hard fouling organisms include calcareous organisms such as barnacles, encrusting bryozoans, mollusks, polychaetes and other tube worms, and zebra mussels. Soft fouling organisms include non-calcareous organisms such as seaweed, hydroids, algae and biofilm "slime". Together, these organisms form a fouling community.

In several situations, bio fouling creates substantial problems. Bio fouling can cause machinery to stop working, water inlets to get clogged, and heat exchangers to suffer from reduced performance. Hence, the topic of anti-fouling, i.e. the process of removing or preventing biofouling, is well-known. In industrial processes involving wetted surfaces, bio dispersants can be used to control biofouling. In less controlled environments, fouling organisms are killed or repelled with coatings using biocides, thermal treatments or pulses of energy. Nontoxic mechanical strategies that prevent organisms from attaching to a surface include choosing a material or coating for causing the surface to be slippery, or creating nanoscale surface topologies similar to the skin of sharks and dolphins which only offer poor anchor points.

In the offshore industry, it is known to provide equipment with a toxic surface onto which biofouling species cannot attach and survive. Alternatively, slow release coatings can be applied. The first approach involves a release of toxic species into the marine environment, which may be prohibited in the future for obvious reasons. The second approach involves a process in which a binder resin slowly dissolves or hydrolyses such as to release a biocidally-active chemical into the immediate near-surface environment, and is expected to be prohibited and abandoned any time soon. Due to the nature of the two approaches and the harm that the bio toxic and biocidally-active materials associated therewith cause also after their release into the seawater, not only to bio fouling organisms but also to other forms of marine life, there is a need for a more environmentally friendly and green approach, which is suitable to be put to practice for the purpose of keeping submerged instrument panels clean from bio fouling.

SUMMARY OF THE INVENTION

It is an object of the invention to provide measures for at least slowing down if not preventing bio fouling of submerged instrument panels. In view thereof, according to the invention, an assembly of an instrument panel and an anti-fouling system is provided, the instrument panel being designed for arrangement on a subsea structure, particularly a subsea tree comprising at least one instrument which is to be inspected and/or manipulated underwater, particularly by means of a remotely operated underwater vehicle, and the anti-fouling system comprising at least one anti-fouling appliance for performing an anti-fouling action on at least a portion of the exterior surface of the instrument panel, wherein the anti-fouling appliance has an exterior arrangement with respect to the instrument panel, in which at least a part of the anti-fouling appliance is supported on the instrument panel and/or is adapted to be otherwise arranged on a subsea structure, and/or is arranged on the exterior surface of the instrument panel, and/or is arranged in the interior of the instrument panel.

In an anti-fouling panel assembly according to the invention, use is made of an anti-fouling appliance for acting on at least a portion of the exterior surface of the instrument panel in order to keep at least a portion of the surface free from bio fouling. Basically, the exterior surface of the instrument panel is the surface of the instrument panel which is exposed to seawater when the instrument panel is in a subsea position, as a result of which a bio-fouling effect may occur on the surface.

Preferably, the anti-fouling appliance is adapted to act on the exterior surface of the instrument panel in such a way that initial deposition of a microbial bio film which facilities subsequent settlement and attachment of macro fouling organisms is prevented. According to the invention, the anti-fouling appliance may act on the surface in any possible way, in particular directly, indirectly, from a position on the surface or close to the surface, from a position remote from the surface, whatever is useful in a given situation. To that end, the anti-fouling appliance may have any suitable position with respect to the surface, and may be arranged in the interior of the instrument panel, may be arranged on the surface, and/or may have an exterior arrangement with respect to the instrument panel, in which at least a part of the anti-fouling appliance is supported on the instrument panel and/or is adapted to be otherwise arranged on a subsea structure.

In an advantageous embodiment of the anti-fouling panel assembly according to the invention, the anti-fouling appliance is adapted to emit anti-fouling energy during operation thereof. It is practical for the anti-fouling appliance to be particularly adapted to emit ultraviolet light during operation thereof. A general advantage of using ultraviolet light for realizing anti-fouling is that the microorganisms are prevented from adhering and rooting on the surface to be kept clean, without any harmful side effects or side effects which cannot be easily counteracted.

For the sake of completeness, the following is noted in respect of anti-fouling by using ultraviolet light. The anti-fouling appliance may be chosen to specifically emit ultraviolet light of the c type (UVC), which is also known as UVC light, and even more specifically, light with a wavelength roughly between 250 nm and 300 nm. It has been found that most fouling organisms are killed, rendered inactive, or rendered unable to reproduce by exposing them to a certain dose of the ultraviolet light. A typical intensity which appears to be suitable for realizing anti-fouling is 10 mW per square meter, to be applied continuously or at a suitable frequency. A very efficient source for producing UVC light is a low pressure mercury discharge lamp, in which an average of 35% of input power is converted to UVC power. Another useful type of lamp is a medium pressure mercury discharge lamp. The lamp may be equipped with an envelope of special glass for filtering out ozone-forming radiation. Furthermore, a dimmer may be used with the lamp if so desired. Other types of useful UVC lamps are dielectric barrier discharge lamps, which are known for providing very powerful ultraviolet light at various wavelengths and at high electrical-to-optical power efficiencies, lasers and light emitting diodes (LEDs). In respect of the LEDs, it is noted that they can generally be included in relatively small packages and consume less power than other types of light sources. LEDs can be manufactured to emit (ultraviolet) light of various desired wavelengths, and their operating parameters, most notably the output power, can be controlled to a high degree.

An anti-fouling appliance for emitting ultraviolet light can be provided in the form of a tubular lamp, more or less comparable to a well-known TL (tube luminescent/fluorescent) lamp. For various known germicidal tubular UVC lamps, the electrical and mechanical properties are comparable to those properties of tubular lamps for producing visible light. This allows the UVC lamps to be operated in the same way as the well-known lamps, wherein an electronic or magnetic ballast/starter circuit may be used, for example.

According to a practical possibility existing within the framework of the invention, the anti-fouling appliance is adapted to emit anti-fouling energy during operation thereof, and at least a part of the instrument panel is transparent to the anti-fouling energy and includes at least a portion of the exterior surface of the instrument panel. On the basis of such feature of the instrument panel, it is possible to have an exterior arrangement of the anti-fouling appliance with respect to the instrument panel, wherein it is not necessary for all of the exterior surface of the instrument panel to be within reach of the anti-fouling appliance, as the instrument panel may be designed so as to allow the anti-fouling energy to couple into the instrument panel at a certain area of the exterior surface as covered by the anti-fouling appliance, to travel further through the instrument panel to other areas of the exterior surface, and to couple out of the instrument panel at those other areas. On the other hand, on the basis of such feature of the instrument panel, it is possible to have an arrangement of the anti-fouling appliance inside the instrument panel, as a transparent nature of at least a part of the instrument panel allows the anti-fouling energy to reach the exterior surface from the interior of the instrument panel.

It may be so that at least a part of the instrument panel is transparent to the anti-fouling energy, and it may even be so that the entire instrument panel is transparent to the anti-fouling energy. In any case, when the instrument panel is at least partially transparent, it is achieved that the instrument panel is suitable to be used as an energy guide for transporting anti-fouling energy received from one or more energy sources for emitting anti-fouling energy during operation thereof. According to one practical option, the instrument panel is partially transparent on the basis of a design in which the instrument panel comprises a basic frame sheet which is non-transparent to the anti-fouling energy, and in which the instrument panel furthermore comprises at least one add-on which is at least partially transparent to the anti-fouling energy. In that case, it may be achieved that applying the invention to an instrument panel does not necessarily need to involve designing the instrument panel in a totally different way, but may involve keeping an original design intact and making use of a possibility to have suitable add-ons. A general advantage of applying one or more add-ons is that the add-ons may come as consumable or serviceable parts which can be deployed or removed as desired. Also, a single type of add-on may be of such design that it is suitable to be used with various types of instrument panel.

As mentioned in the foregoing, it is known for instrument panels to be provided with tags. In particular, in the anti-fouling panel assembly according to the invention, the instrument panel may comprise at least one tag element adapted to realize a readable indication, wherein the anti-fouling appliance is adapted to perform an anti-fouling action on at least the tag element. It is possible for such tag element to be associated with an instrument add-on which is at least partially transparent to anti-fouling energy and which is arranged for accommodating at least an element of an instrument. In that case, it is advantageous for the anti-fouling system to comprise an anti-fouling appliance which is arranged for emitting anti-fouling energy to both the instrument add-on and the tag element associated therewith. In this respect, it may particularly be practical for the instrument add-on to be entirely transparent to the anti-fouling energy and for the anti-fouling appliance to be at least partially incorporated in the instrument add-on and/or arranged on the exterior surface of the instrument panel at the position of the instrument add-on. For example, the instrument add-on may be generally cylinder-shaped so as to be capable of accommodating an elongated part of an instrument, such as a control handle, by encompassing the elongated part, and the anti-fouling appliance may have an elongated appearance and may be designed for arrangement with respect to the instrument add-on in a spiral-like fashion.

In general, the anti-fouling appliance may comprise at least one energy source of any suitable type, of any suitable shape, and in any suitable arrangement with respect to the instrument panel. Furthermore, the anti-fouling appliance may also comprise at least one energy guide of any suitable type, of any suitable shape, and in any suitable arrangement with respect to the instrument panel. Hence, an elongated appearance of the anti-fouling appliance, in which case the anti-fouling appliance may be arranged so as to spiral with respect to an instrument add-on or another element of the instrument panel, is just one of the many possibilities existing within the framework of the invention.

The fact is that the tag element itself may be provided as an add-on of the instrument panel as well, in which case the tag element may be composed of a universal plug portion and customized portions forming letters, numerals or other signs. For the purpose of having excellent readability of the tag element, it may be advantageous if the anti-fouling appliance is not only adapted to emit anti-fouling energy, but to also emit energy which is suitable for enabling a read-out of the tag element by an operator of a remotely controlled underwater vehicle, or by a sensor (camera) of such vehicle, for example. In this respect, it is noted that the anti-fouling appliance may comprise a light source which is capable of emitting light of various wavelengths, particularly visible light and ultraviolet light. In such case, the anti-fouling appliance may particularly be adapted to emit the two types of energy in an alternating fashion.

As mentioned in the foregoing, it is possible for the anti-fouling appliance to be arranged in the interior of the instrument panel. It is also possible to have an arrangement in which a part of the anti-fouling appliance is arranged in the interior of the instrument panel, and in which a part of the anti-fouling appliance is arranged on the exterior surface of the instrument panel and/or at a distance from the instrument panel. In an example of an arrangement in which the anti-fouling appliance is at least partially arranged in the interior of the instrument panel, the anti-fouling appliance comprises at least one anti-fouling energy source for emitting anti-fouling energy during operation thereof, the at least one energy source being incorporated in the instrument panel. In a practical embodiment, the at least one anti-fouling energy source may comprise at least one tubular ultraviolet light source, or may comprise an array of ultraviolet LEDs.

Additionally or alternatively, the anti-fouling appliance may comprise at least one anti-fouling energy source for emitting anti-fouling energy during operation thereof, at a remote exterior position with respect to the instrument panel, and may furthermore comprise an energy guide for receiving anti-fouling energy from the energy source during operation thereof and guiding the anti-fouling energy to the instrument panel. For example, the anti-fouling energy source may be arranged at a remote location, such as at a surface vessel. When the anti-fouling energy source is a light source for emitting ultraviolet light, the energy guide may be any suitable light guide such as an optical fiber or light hose. It may be so that the energy guide is suitable for arrangement completely outside of the instrument panel, but that does not alter the fact that it is also possible to use an energy guide of which at least a portion is suitable for arrangement in the interior of the instrument panel, in which case it is practical for the instrument panel to comprise at least one part which is transparent to the anti-fouling energy emitted by the energy source during operation thereof and transported to the instrument panel by the energy guide, the part of the instrument panel including at least a portion of the exterior surface of the instrument panel, as mentioned in the foregoing.

In general, both structures in which the at least one anti-fouling appliance is allowed to act directly on at least a portion of a surface to be kept clean and structures in which the at least one anti-fouling appliance is allowed to act indirectly on at least a portion of a surface to be kept clean are possible within the scope of the invention, wherein the at least one anti-fouling appliance may be arranged in the interior of the instrument panel, on the exterior surface of the instrument panel, and/or at an exterior position with respect to the instrument panel. In the case of indirect action of the anti-fouling appliance, assuming that the anti-fouling appliance is adapted to emit anti-fouling energy during operation thereof, it is practical for the anti-fouling system to comprise reflecting means, i.e. one or more reflectors, for directing the energy towards at least a portion of the exterior surface of the instrument panel. Using one or more reflectors may add to freedom of design of the anti-fouling system, realizing more possibilities for determining an appropriate positioning of the at least one anti-fouling appliance. Also, using one or more reflectors involves the advantageous possibility of spreading the energy across a surface area which is larger than the surface area which would be covered in a situation of the anti-fouling appliance acting directly on the surface.

In an embodiment of the anti-fouling panel assembly according to the invention, the anti-fouling system comprises a structure holding at least a part of the anti-fouling appliance at a position which is a position at a distance from the instrument panel. Hence, in this embodiment, at least a part of the anti-fouling appliance has an exterior arrangement with respect to the instrument panel. Such structure may be of any suitable type and may be present at any suitable location with respect to the instrument panel. In this respect, it is noted that it may be advantageous for the structure to be positioned behind the instrument panel as seen from a side of the instrument panel which is intended to be accessible by a remotely operated underwater vehicle, as in that case, the structure cannot be in the way between the instrument panel and a remotely operated underwater vehicle, wherein it is furthermore noted that in that case, it is very well possible for the instrument panel to be of such design that the entire exterior surface thereof is under the influence of the anti-fouling appliance, despite an arrangement of the anti-fouling appliance at only one side of the instrument panel, for example, a design according to which the instrument panel is enabled to function as an energy guide. It may be so that an instrument panel comprising a traditional basic frame sheet is used, and that the anti-fouling system comprises an optical panel which is arranged behind the instrument panel, as a stand-off, in which case the known mechanical parameters and performance of the instrument panel remain unchanged.

In respect of the possibility of having at least one anti-fouling appliance arranged at an exterior position with respect to the instrument panel, it is noted that the anti-fouling system may comprise an arrangement for holding the anti-fouling appliance at a position which is a position at a distance from the instrument panel, and which is a position for allowing anti-fouling energy to reach the exterior surface of the instrument panel, directly and/or indirectly, whatever may be appropriate in a particular case. When the anti-fouling appliance is adapted to emit ultraviolet light during operation thereof, a remote configuration may comprise flood or spot light sources, illuminating the exterior surface of the instrument panel from an add-on of the instrument panel, for example. The anti-fouling appliance may even comprise a laser light source, wherein the laser light source may be arranged such as to scan the surface. Advantageously, an arrangement for holding at least one energy source and/or at least one energy guide is adapted to provide mechanical protection of the energy source(s) and/or the energy guide(s).

It follows from the foregoing that the invention relates to an assembly of an instrument panel and an anti-fouling system which is adapted to be operated to perform an anti-fouling action on at least a portion of the exterior surface of the instrument panel. Hence, by applying the invention, problems associated with a fouled condition of the exterior surface of an instrument panel are alleviated. One or more parts of the instrument panel having a function in allowing access to at least an element of at least one instrument of a subsea tree stay open, and readability of any tags present on the instrument panel is maintained. The invention also relates to an anti-fouling system comprising at least one anti-fouling appliance for performing an anti-fouling action on at least a portion of the exterior surface of an instrument panel, the anti-fouling system being intended for use in the anti-fouling panel assembly as mentioned. Furthermore, the invention relates to an instrument panel being designed for arrangement on a subsea structure, particularly a subsea tree comprising at least one instrument which is to be inspected and/or manipulated underwater, particularly by means of a remotely operated underwater vehicle, the instrument panel furthermore being designed for providing access to at least an element of the at least one instrument, and the instrument panel being intended for use in the anti-fouling panel assembly as mentioned.

In respect of the anti-fouling panel assembly according to the invention, it is noted that such assembly may be part of a marine system which furthermore comprises a subsea structure, particularly a subsea tree comprising at least one instrument which is to be inspected and/or manipulated underwater, particularly by means of a remotely operated underwater vehicle, wherein the instrument panel of the assembly is arranged for allowing access to at least an element of the at least one instrument.

The above-described and other aspects of the invention will be apparent from and elucidated with reference to the following detailed description of a number of embodiments of an anti-fouling panel assembly, i.e. an assembly of an instrument panel and an anti-fouling system.

BRIEF DESCRIPTION OF THE DRAWINGS

The invention will now be explained in greater detail with reference to the figures, in which equal or similar parts are indicated by the same reference signs, and in which:

FIGS. 5-7 diagrammatically show different views of a detail of an anti-fouling panel assembly in which the instrument panel comprises at least one instrument add-on for encompassing a control handle of an instrument, and a tag element associated with the at least one instrument add-on, and in which the anti-fouling system comprises fiber optics incorporated in the at least one instrument add-on.

DETAILED DESCRIPTION OF EMBODIMENTS

The invention is in the field of instrument panels, particularly instrument panels which are also known as ROV panels, and which are normally used in a marine environment as a part of a subsea structure, particularly a subsea tree which is equipped with at least one instrument to be inspected and/or manipulated underwater, particularly by a remotely operated underwater vehicle, wherein the instrument panel is used to partially cover the subsea tree while allowing access to at least an element of the at least one instrument in a defined manner.

Figure 1:
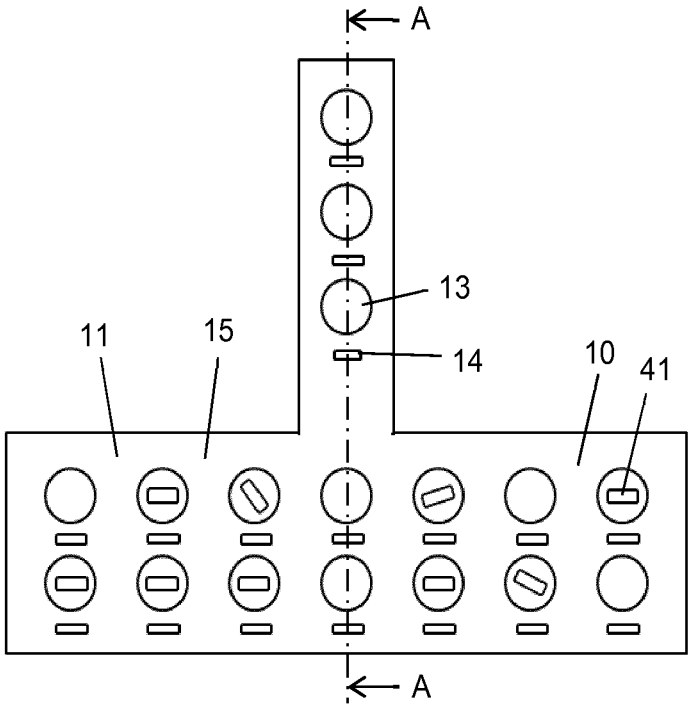
FIG. 1 illustrates a general design of an instrument panel, diagrammatically showing a front view of a possible embodiment of an instrument panel, and furthermore diagrammatically showing a number of control elements of instruments of a subsea tree on which the instrument panel is supposed to be arranged.
Figure 2:
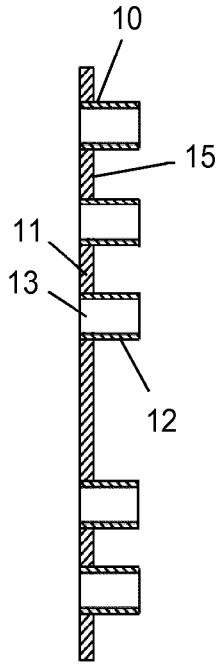
FIG. 2 diagrammatically shows a view of a section of the instrument panel taken along the line A-A in FIG. 1.

FIGS. 1 and 2 show a possible embodiment of an instrument panel 10. The instrument panel 10 comprises a basic frame sheet 11 and a number of cylindrical instrument add-ons 12, the basic frame sheet 11 being provided with openings 13 at the positions of the instrument add-ons 12. The instrument add-ons 12 are designed so as to be capable of encompassing at least an element of instruments of the subsea tree. In the following, it is assumed that the instruments comprise valves, that the valves are controllable through a control handle 41, and that the instrument add-ons 12 are suitable for realizing an arrangement in which a control handle 41 of a valve extends inside the instrument add-ons 12. For illustration purposes, a number of control handles 41 are diagrammatically depicted in the front view of the instrument panel 10 as shown in FIG. 1. For the sake of completeness, it is noted that in this description, the indication "front" relates to a side of the instrument panel 10 which may be approached by a remotely operated underwater vehicle, and that the indication "back" relates to the other side of the instrument panel 10, i.e. the side facing the subsea tree. Hence, the positioning of the instrument add-ons 12 can be denoted as being a positioning at the back side of the instrument panel 10.

In the configuration as shown in FIGS. 1 and 2, each of the control handles 41 of the valves of the subsea tree is freely accessible at the front side of the instrument panel 10, through the opening 13 in the instrument panel 10 associated with the instrument add-on 12 through which the control handle 41 extends. The instrument panel 10 is equipped with tags 14, each tag 14 being associated with an opening 13. The tags 14 serve for providing a readable indication so that the various openings 13 may be recognized, on the basis of which safe and correct control of the valves is guaranteed at all times.

FIGS. 3-7 illustrate various embodiments of an anti-fouling panel assembly 1, 2, 3 according to the invention. The invention is in no way restricted to the design of the instrument panel 10 as shown in FIGS. 1 and 2, and as explained in the foregoing. The embodiments of the anti-fouling panel assembly 1, 2, 3 shown in FIGS. 3-7 are just a number of examples out of numerous possibilities existing within the framework of the invention.

In general, according to the invention, an anti-fouling system 20 is designed for realizing an anti-fouling effect on the exterior surface 15 of the instrument panel 10. In the context of this description, the term "exterior surface" should be understood such as to include every area of the instrument panel 10 which is exposed to water when the instrument panel 10 is in an underwater environment. In a situation without anti-fouling measures being taken, the exterior surface 15 gets covered with a bio fouling layer as time passes, which causes the openings 13 to get clogged, which could ultimately hinder access to the control handles 41 of the valves, and which deteriorates the readability of the tags 14, which could ultimately lead to errors in recognizing the various openings 13. When the invention is applied, such significant problems are avoided. The fact is that according to the invention, an anti-fouling system 20 is provided which comprises one or more anti-fouling appliances for acting on at least a portion of the exterior surface 15 of the instrument panel 10 in order to keep at least a portion of the surface 15 free from bio fouling. The one or more anti-fouling appliances may have any suitable position with respect to the instrument panel 10, and may be arranged in the interior of the instrument panel 10, on the exterior surface 15 of the instrument panel 10 and/or at an exterior position with respect to the instrument panel 10. The one or more anti-fouling appliances may particularly comprise one or more anti-fouling energy sources for emitting anti-fouling energy during operation thereof, wherein the one or more anti-fouling appliances may furthermore comprise one or more energy guides for transporting the anti-fouling energy and allowing it to be output at positions which are appropriate for realizing anti-fouling effects on the exterior surface 15 of the instrument panel 10 in an efficient manner. It is possible for the anti-fouling system to further comprise one or more reflectors for directing and distributing the anti-fouling energy as desired. An exterior structure or add-on may be used with the instrument panel 10 for holding/guiding one or more energy sources and/or one or more energy guides. In case the one or more energy sources are arranged in, on or close to the instrument panel 10, it is advantageous to use suitable means for powering the energy sources, which may comprise an electrical cable or the like extending from the energy sources to the surface, wherein the energy sources may be electrically coupled to the electrical cable either in a wired manner or in a wireless manner, or which may comprise devices for locally generating the necessary power, such as so-called Peltier elements which are adapted to generate an electric current on the basis of a temperature difference. In the following, by way of example only, it is assumed that the one or more energy sources come as one or more light sources for emitting ultraviolet light, especially ultraviolet light of the c type, during operation thereof. UVC light is a form of energy which is suitable for killing fouling organisms, rendering such organisms inactive, or rendering such organisms unable to reproduce.

Figure 3:
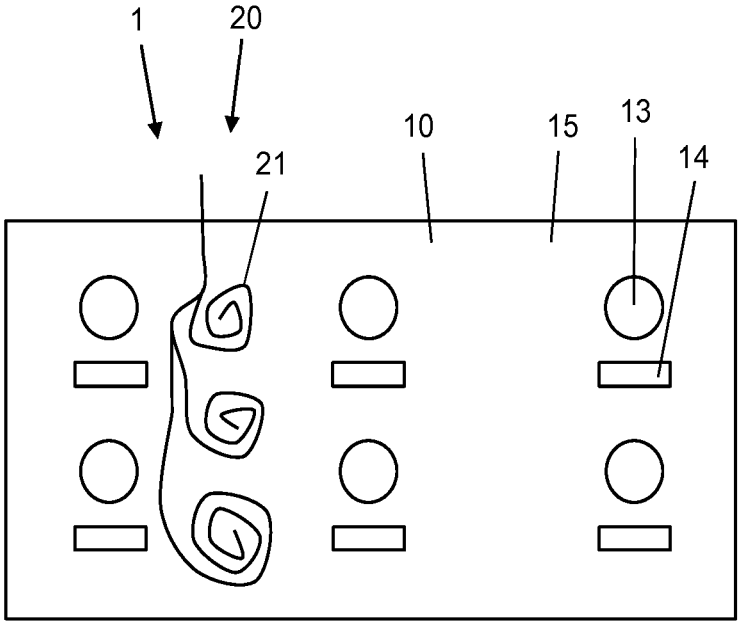
FIG. 3 diagrammatically shows an anti-fouling panel assembly in which the anti-fouling system comprises fiber optics which are partially arranged in the interior of the instrument panel.

FIG. 3 relates to an anti-fouling panel assembly 1 in which the anti-fouling system 20 comprises at least one optical fiber 21 which is arranged so as to extend in the interior of the instrument panel 10. The optical fiber 21 can have any suitable size and can be arranged according to any suitable shape inside the instrument panel 10, wherein the optical fiber 21 may be designed to couple ultraviolet light into the instrument panel 10 at any appropriate position. In this embodiment of the anti-fouling assembly 1 according to the invention, the instrument panel 10 comprises material which is transparent to ultraviolet light, so as to allow the ultraviolet light emitted by the optical fiber 21 during operation thereof to reach at least a portion of the exterior surface 15 of the instrument panel 10, wherein at least a part of the instrument panel 10 may serve as a light guide. The instrument panel 10 may comprise quartz glass, soda-lime glass, silicone, or any other suitable ultraviolet transparent material. By means of the at least one optical fiber 21, the instrument panel 10 can be illuminated from within.

A feasible alternative of the at least one optical fiber 21 is a plurality of embedded light sources such as LEDs adapted to emit ultraviolet light. By applying a plurality of LEDs, it is possible to have failure of one or another limited number of LEDs and still have an anti-fouling effect on the exterior surface 15 of the instrument panel 10 as desired. Also, LEDs are known for a low consumption of energy. According to another option, the at least partially ultraviolet transparent instrument panel 10 can be side or back lit, using suitable ultraviolet lamps, for example. In addition, metal or other fiber-based materials or meshes can be integrated in the instrument panel 10 for realizing both mechanical and electrical functions as desired.

The instrument panel 10 may be of any suitable design and of any suitable size. In a practical embodiment, the instrument panel 10 may be hardened and/or armored, so that the instrument panel 10 is realized in the form of a multi-layer laminate. The exterior surface 15 of the instrument panel 10 can be fully ultraviolet transparent, diffuse or reflecting at either the front side or the back side of the instrument panel 10, either in part, for example, at positions of embedded icons, texts, etc., which may have a function in forming tags 14 of the instrument panel 10, or in full. When the instrument panel 10 is equipped with a plurality of LEDs or other suitable ultraviolet light sources, as mentioned, the light sources may be arranged in pockets or cavities within the instrument panel 10, particularly in one or more of the layers of the instrument panel 10 in case the instrument panel 10 is manufactured as a multi-layer laminate, in order to protect the light sources from the environment, so that disadvantageous effects such as corrosion or mechanical damage due to high pressure prevailing in a subsea environment may be avoided. It is furthermore possible to have a design of the instrument panel 10 in which a power source or a power generator for powering at least one light source and/or at least one light guide is embedded in the instrument panel 10, which does not alter the fact that such power source or power generator may be arranged at any suitable position with respect to the instrument panel 10 within the framework of the invention, particularly possible positions on the instrument panel 10 and possible positions at a distance from the instrument panel 10.

The instrument panel 10 may come with surface or volume machined indicator letters, numerals, icons, symbols; whatever is appropriate for realizing tags 14 as desired. Optionally, the instrument panel 10 can be provided with the signs of a tag 14 by applying a technique known as laser scribing, which involves gas bubble formation. Furthermore, the tags 14 may be machined by applying embossing techniques or extrusion techniques, or can be added on top of the exterior surface 15 of the instrument panel 10 and/or be depressed into the surface 15, wherein it is possible for the surface 15 to be provided with one or more different micro patterns at those local structures for the purpose of locally manipulating light distribution and/or coupling out of light.

It is a general option for the at least partially ultraviolet transparent instrument panel 10 to be operated as a light guide at different wave lengths with at least one wavelength covering the ultraviolet spectrum, in particular at least the UVC band thereof, wherein it is possible to improve readability of the tags 14 by alternating visible and/or infrared light with the ultraviolet light.

Figure 4:
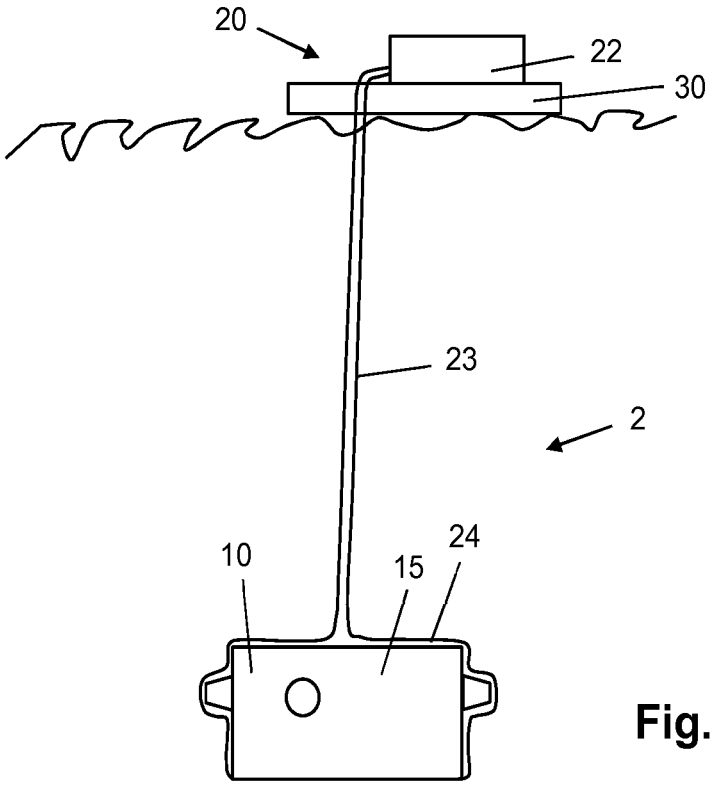
FIG. 4 diagrammatically shows an anti-fouling panel assembly in which the anti-fouling system comprises a light source which is located at a distance from the instrument panel, particularly at a surface vessel, and in which the anti-fouling system furthermore comprises a light guide extending down from the light source to the instrument panel.

FIG. 4 relates to an anti-fouling panel assembly 2 in which the anti-fouling system 20 comprises an ultraviolet laser source 22 having a remote, exterior arrangement with respect to the instrument panel 10 as mounted on a subsea tree, being located on a surface vessel 30, and furthermore comprises an elongated light guide 23 coupled to the ultraviolet laser source 22, the light guide 23 extending all the way down to the instrument panel 10. In the shown example, an end portion 24 of the light guide 23 is configured and arranged so as to realize a configuration in which the instrument panel 10 is packed in the end portion 24, which does not alter the fact that alternatives are possible, for example an alternative according to which an end portion 24 of the light guide 23 extends to inside the instrument panel 10, in which case it is advantageous for the instrument panel 10 to be at least partially ultraviolet transparent, as described in the foregoing. The elongated light guide 23 may comprise any suitable type of optical fiber or the like for transporting ultraviolet light with only a minimum loss on the basis of a known principle such as total internal reflection.

An advantage associated with the anti-fouling panel assembly 2 shown in FIG. 4 resides in the fact that the ultraviolet laser source 22 can be at a position above the water. Consequently, the anti-fouling panel assembly 2 can do without maintenance, that is to say, maintenance which would need to be performed in an underwater environment. If the ultraviolet laser source 22 fails, the anti-fouling system 20 can simply be repaired by replacing the well-accessible ultraviolet laser source 22.

Figure 5:
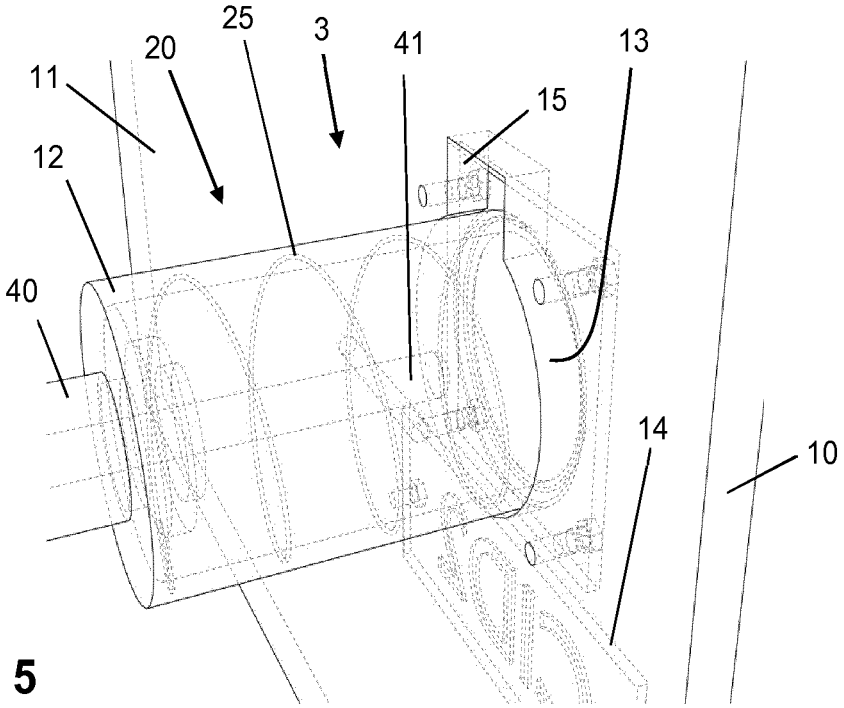
Figure 6:
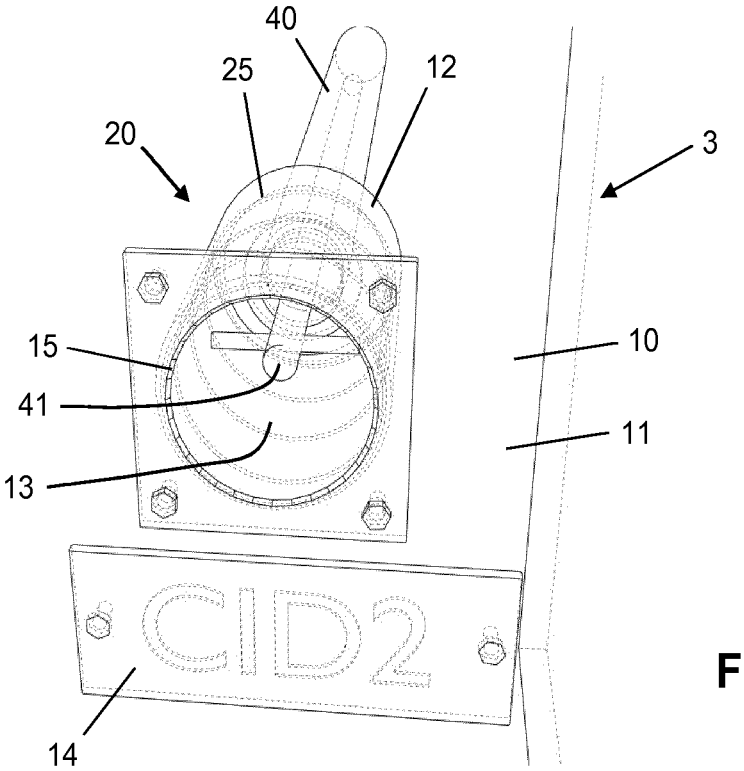
Figure 7:
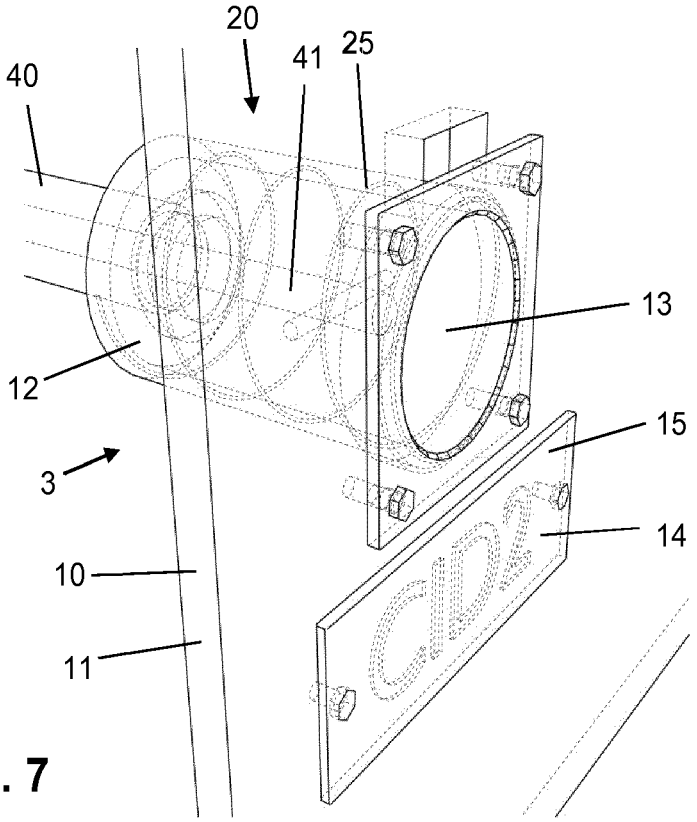

FIGS. 5-7 relate to an anti-fouling panel assembly 3 comprising an instrument panel 10 which is of the general design as explained earlier on the basis of FIGS. 1 and 2, the instrument panel 10 comprising a basic frame sheet 11 and at least one cylindrical instrument add-on 12. FIGS. 5-7 show a detail of the anti-fouling panel assembly 3, particularly one instrument add-on 12, a portion of the basic frame sheet 11 from which the instrument add-on 12 projects, wherein a control handle 41 of a valve 40 of a subsea tree, extending inside the instrument add-on 12, is shown in FIGS. 5-8 as well.

In the anti-fouling panel assembly 3 shown in FIGS. 5-7, the at least one instrument add-on 12 is designed to serve as a local light guide, being ultraviolet transparent, and including at least one ultraviolet light source 25. In the shown example, the at least one ultraviolet light source 25 has an elongated shape and is arranged so as to follow a spiral path in the instrument add-on 12, which does not alter the fact that numerous alternatives are possible, wherein additionally or alternatively, at least one light guide may be associated with the instrument add-on 12.

By having an instrument add-on 12 which is designed to encompass the control handle 41 of a valve 40, and which is furthermore designed to emit ultraviolet light, including at least one suitable ultraviolet light source 25 and/or at least one suitable light guide, it is possible to have an anti-fouling action performed on the control handle 41. Hence, biofouling of both the exterior surface 15 of the instrument panel 10 at the position of the instrument add-on 12 and the control handle 41 can be prevented, so that maximum accessibility and proper manipulation of the control handle 41 can be ensured at all times. Furthermore, ultraviolet light emitted from the instrument add-on 12 can be used for performing an anti-fouling action on a tag element 14 associated with the instrument add-on 12, the tag element 14 being lit at the back in the process.

The cylindrical shape of the instrument add-on 12 of the instrument panel 10 of the anti-fouling panel assembly 3 is just one of numerous possible shapes. An instrument add-on 12 being designed for realizing some type of optical enclosure extending from an opening 13 of the instrument panel 10 may alternatively come in the form of a strip-shaped spiral, an optical fiber in a spiral arrangement, a square box, etc., whatever is appropriate for achieving an anti-fouling effect as desired and for avoiding interference with a remotely operated underwater vehicle and/or avoiding hinder of access of such vehicle to an instrument to be inspected/manipulated by the vehicle, or to at least to one or more elements of such instrument.

It is possible for the tag element 14 to comprise a strip of material which is provided with holes having the shape of the signs as intended. In such case, the holes can be back lit by means of any suitable ultraviolet light source and/or light guide adapted to provide ultraviolet light at the back side of the instrument panel 10. Readability of the tag 14 is then ensured on the basis of both material absence and back side illumination.

In respect of the at least one anti-fouling appliance, i.e. the at least one ultraviolet light source and/or the at least one light guide, which is part of the anti-fouling system 20 of the anti-fouling panel assembly according to the invention, it is noted that within the framework of the invention, it is possible for the anti-fouling appliance to be front mounted on a traditional instrument panel 10, either as a stand-off or as a surface cladding layer using a UVC reflective surface in between. As a consequence, potential doubts about the mechanical integrity of the instrument panel 10 can be circumvented. Alternatively, to ensure that impact load requirements are complied with, an optical panel may be provided and mounted as a stand-off at the back side of an instrument panel 10 comprising a traditional basic frame sheet 11, in which case the known mechanical parameters and performance of the instrument panel 10 remain unchanged.

It will be clear to a person skilled in the art that the scope of the invention is not limited to the examples discussed in the foregoing, but that several amendments and modifications thereof are possible without deviating from the scope of the invention as defined in the attached claims. It is intended that the invention be construed as including all such amendments and modifications insofar they come within the scope of the claims or the equivalents thereof. While the invention has been illustrated and described in detail in the figures and the description, such illustration and description are to be considered illustrative or exemplary only, and not restrictive. The invention is not limited to the disclosed embodiments. The drawings are schematic, wherein details that are not required for understanding the invention may have been omitted, and not necessarily to scale.

Variations to the disclosed embodiments can be understood and effected by a person skilled in the art in practicing the claimed invention, from a study of the figures, the description and the attached claims. In the claims, the word "comprising" does not exclude other steps or elements, and the indefinite article "a" or "an" does not exclude a plurality. The term "comprise" as used in this text will be understood by a person skilled in the art as covering the term "consist of". Hence, the term "comprise" may in respect of an embodiment mean "consist of", but may in another embodiment mean "contain/include at least the defined species and optionally one or more other species". Any reference signs in the claims should not be construed as limiting the scope of the invention.

Elements and aspects discussed for or in relation with a particular embodiment may be suitably combined with elements and aspects of other embodiments, unless explicitly stated otherwise. Thus, the mere fact that certain measures are recited in mutually different dependent claims does not indicate that a combination of these measures cannot be used to advantage.

The invention can be summarized as follows. In an assembly of an instrument panel 10 and an anti-fouling system 20, the instrument panel 10 is designed for arrangement on a subsea structure, particularly a subsea tree comprising at least one instrument 40 which is to be inspected and/or manipulated underwater, particularly by means of a remotely operated underwater vehicle, and the anti-fouling system 20 comprises at least one anti-fouling appliance 21, 22, 23, 25 for performing an anti-fouling action on at least a portion of the exterior surface 15 of the instrument panel 10. The anti-fouling appliance 21, 22, 23, 24 may have at least one of various possible arrangements with respect to the instrument panel 10, including an exterior arrangement and an interior arrangement, and an arrangement on the exterior surface 15 of the instrument panel 10, wherein anti-fouling energy may be supplied to the surface 15 in at least one of a direct and an indirect fashion. In a practical embodiment, the anti-fouling appliance 21, 22, 23, 25 comprises an ultraviolet light source 21, 22, 25 and possibly also a light guide 23 coupled to the ultraviolet light source 21, 22, 25.

The invention claimed is:

1. An assembly comprising:

an instrument panel, wherein the instrument panel is arranged on a subsea structure, wherein the instrument panel comprises at least one instrument, wherein the at least one instrument is arranged to be inspected underwater, and an anti-fouling system, wherein the anti-fouling system comprises an anti-fouling appliance, wherein the anti-fouling system is arranged to perform an anti-fouling action on at least one portion of an exterior surface of the instrument panel, wherein the anti-fouling appliance is arranged to emit anti-fouling energy during operation, and wherein at least one part of the instrument panel is transparent to the anti-fouling energy.

2. The assembly of claim 1, wherein the instrument panel comprises a basic frame sheet, wherein the instrument panel further comprises at least one add-on element, and wherein the at least one add-on element is at least partially transparent to the anti-fouling energy.

3. The assembly of claim 1, wherein the instrument panel comprises at least one tag element configured to realize a readable indication, and wherein the anti-fouling appliance is configured to perform an anti-fouling action on the at least the tag element.

4. The assembly of claim 3, wherein the anti-fouling appliance comprises at least one add-on element, wherein the at least one tag element is associated with the at least one instrument, wherein the at least one add-on element is at least partially transparent to the anti-fouling energy, wherein the at least one add-on element is configured to accommodate at least one element of the at least one instrument, and wherein the anti-fouling appliance is configured to emit the anti-fouling energy to both the at least one element of the at least one instrument and the at least one tag element.

5. The assembly of claim 4, wherein the anti-fouling appliance is arranged on the exterior surface of the instrument panel at a position of the at least one instrument.

6. The assembly of claim 4, wherein the at least one element of the at least one instrument comprises a control element, and wherein the control element is configured to be manipulated underwater.

7. The assembly of claim 3, wherein the at least one tag element is another add-on element of the instrument panel.

8. The assembly of claim 3,
wherein the anti-fouling appliance is configured to alternately emit the anti-fouling energy and other energy, and
wherein the other energy is suitable for enabling a readout of the at least one tag element.

9. The assembly of claim 1,
wherein the anti-fouling appliance is at least partially arranged in an interior of the instrument panel,
wherein the anti-fouling appliance comprises at least one anti-fouling energy source for emitting the anti-fouling energy during operation, and
wherein the at least one anti-fouling energy source is incorporated in the instrument panel.

10. The assembly of claim 1,
wherein the anti-fouling appliance comprises at least one anti-fouling energy source,
wherein the at least one anti-fouling energy source is arranged to emit the anti-fouling energy during operation,
wherein the at least one anti-fouling energy source is arranged at a remote exterior position with respect to the instrument panel,
wherein the at least one anti-fouling energy source comprises an energy guide,
wherein the energy guide is arranged to receive the anti-fouling energy from the at least one anti-fouling energy source during operation, and
wherein the energy guide is arranged to guide the anti-fouling energy to the instrument panel.

11. The assembly of claim 1,
wherein the anti-fouling appliance is arranged to emit the anti-fouling energy during operation,
wherein the anti-fouling system comprises a reflecting element, and
wherein the reflecting element is arranged to direct the anti-fouling energy towards the at least one portion of the exterior surface of the instrument panel.

12. The assembly of claim 1,
wherein the anti-fouling system comprises a structure,
wherein the structure is arranged to hold at least a part of the anti-fouling appliance at a position,
wherein the position is at a distance from the instrument panel,
wherein the structure is positioned behind the instrument panel as seen from one side of the instrument panel, and
wherein the one side of the instrument panel is intended to be accessible by a remotely operated underwater vehicle.

13. The assembly of claim 1,
wherein the anti-fouling appliance comprises at least one energy source,
wherein the at least one energy source is arranged to emit the anti-fouling energy during operation, and
wherein the anti-fouling energy is ultraviolet light.

14. The assembly of claim 1,
wherein the anti-fouling appliance is arranged in an interior of the instrument panel, and
wherein the anti-fouling appliance emits the anti-fouling energy from the interior of the instrument panel to the exterior surface through the at least one part of the instrument panel that is transparent to the anti-fouling energy.

15. The assembly of claim 1,
wherein the at least one instrument comprises a control element,
wherein the control element is configured to be manipulated underwater, and
wherein the anti-fouling system is arranged to perform the anti-fouling action on the control element.

16. An assembly comprising:
an instrument panel,
wherein the instrument panel is arranged on a subsea structure,
wherein the instrument panel comprises at least one instrument,
wherein the at least one instrument is arranged to be inspected underwater; and
an anti-fouling system,
wherein the anti-fouling system comprises an anti-fouling appliance,
wherein the anti-fouling appliance is arranged to perform an anti-fouling action on at least one portion of an exterior surface of the instrument panel,
wherein the anti-fouling appliance is in an interior of the instrument panel,
wherein the anti-fouling appliance is configured to emit anti-fouling energy during operation, and
wherein the at least one portion of an exterior surface of the instrument panel is transparent to the anti-fouling energy.

17. The assembly of claim 16,
wherein the at least one instrument comprises a control element,
wherein the control element is configured to be manipulated underwater, and
wherein the anti-fouling system is arranged to perform the anti-fouling action on the control element.

18. A marine system comprising:
a subsea structure,
wherein the subsea structure includes an instrument,
wherein the instrument is arranged to be inspected underwater;
an assembly comprising:
an instrument panel,
wherein the instrument panel is designed for arrangement on the subsea structure,
wherein the instrument panel comprises the instrument; and
an anti-fouling system,
the anti-fouling system comprising an anti-fouling appliance,
wherein the anti-fouling appliance is arranged to perform an anti-fouling action on at least one portion of an exterior surface of the instrument panel,
wherein the anti-fouling appliance is arranged to emit anti-fouling energy during operation,
wherein at least one part of the instrument panel is transparent to the anti-fouling energy, and
wherein the at least one part of the instrument panel includes the at least one portion of the exterior surface of the instrument panel.

19. The marine system of claim 18,
wherein the at least one instrument comprises a control element,
wherein the control element is configured to be manipulated underwater, and
wherein the anti-fouling system is arranged to perform the anti-fouling action on the control element.

20. The marine system of claim 18,
wherein the instrument panel comprises at least one tag element configured to provide a readable indication, and wherein the anti-fouling appliance is configured to perform the anti-fouling action on the at least the tag element.

* * * * *